US005186869A

United States Patent [19]

Stumpf et al.

[11] Patent Number: 5,186,869

[45] Date of Patent: Feb. 16, 1993

[54] ELECTRONICALLY CONTROLLED CENTRAL AIR FRESHENING SYSTEM AND METHOD FOR USING SAME

[76] Inventors: Donald D. Stumpf, 13418 Floral Ave.; Scott A. Stager, 1449 View Pointe Ave., both of Poway, Calif. 92064

[21] Appl. No.: 775,469

[22] Filed: Oct. 15, 1991

[51] Int. Cl.[5] ..... B01F 3/04; B01F 5/00

[52] U.S. Cl. ..... 261/30; 261/99; 261/81; 261/95; 261/DIG. 65; 422/124

[58] Field of Search ..... 422/124; 261/DIG. 65, 261/30, 99, 81, 95

[56] References Cited

U.S. PATENT DOCUMENTS

| | | | |
|---|---|---|---|
| 985,515 | 2/1911 | Dorman | 261/99 |
| 1,275,583 | 8/1918 | Mathus | 261/81 |
| 2,767,807 | 10/1956 | Booth | 261/99 |
| 2,867,866 | 1/1959 | Steele | 422/124 |
| 3,418,068 | 12/1968 | Gilbertson | 422/124 |
| 3,930,797 | 1/1976 | Gertz | 422/124 |
| 4,601,886 | 7/1986 | Hudgins | 261/DIG. 65 |
| 4,617,157 | 10/1986 | Stein et al. | 422/124 |
| 5,023,020 | 6/1991 | Machida et al. | 261/DIG. 65 |

*Primary Examiner*—Tim Miles
*Attorney, Agent, or Firm*—Ralph S. Branscomb

[57] ABSTRACT

An apparatus for injecting air freshener or other airborn vapor into the air of a building, mounts to the side of a manifold or other air passageway, which is part of the building air conditioning or heating system. A solid, liquid-saturated dispersant cylinder is ultimately inserted into the passageway and removed from the passageway into a substantially sealed container by means of an electric motor drive which is controlled by a microprocessor-driven control system. The programmable control system is set to introduce the solid dispersant into the air passageway at selectable times of the day and for a set duration, but may be overridden manually in the event a party is to be held, etc.

11 Claims, 2 Drawing Sheets

Fig. 1
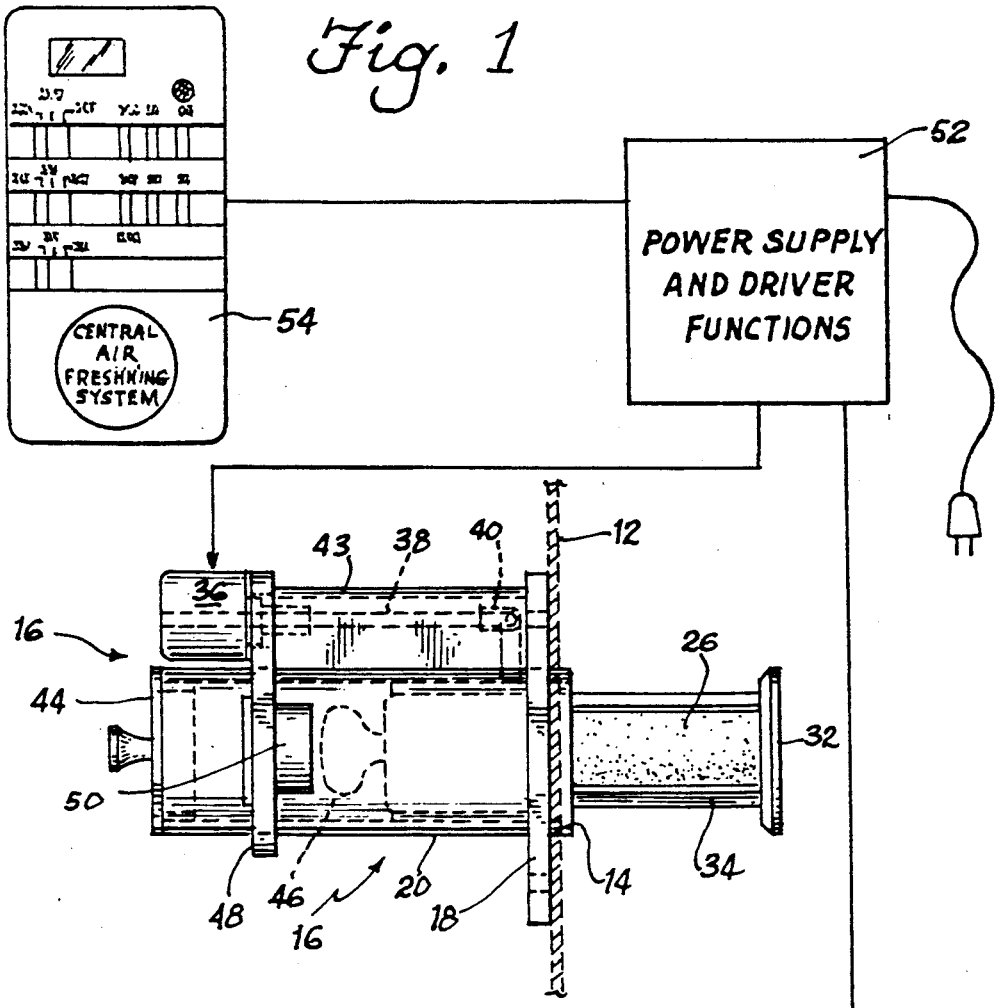
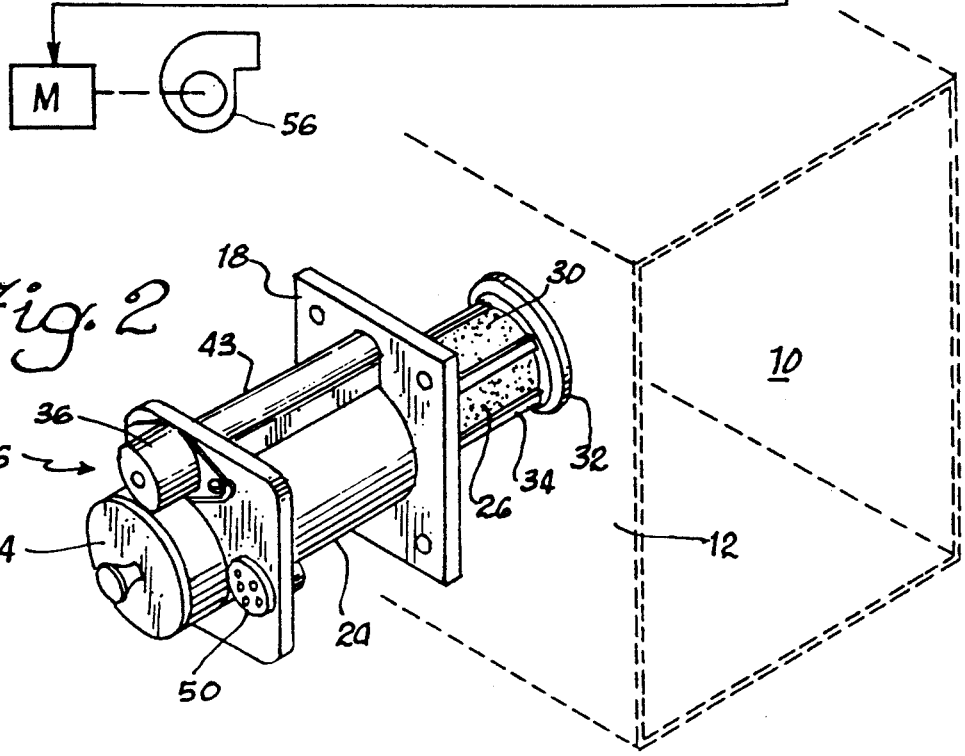
Fig. 2

ELECTRONICALLY CONTROLLED CENTRAL AIR FRESHENING SYSTEM AND METHOD FOR USING SAME

BACKGROUND OF THE INVENTION

The invention is in the field of air treatment apparatuses and equipment for commercial and residential buildings. These include systems for filtering the air, passing the air through bactericidal ultra-violet light paths, and adding a bactericide or air freshener to the air. This can be done in a number of ways. Different modes of achieving these ends are set forth in the following U.S. Patents.

Generally larger systems, which use liquid air freshener or bactericide, and many of which comprise stand-alone units with others incorporating spray means for conditioning the air, are set forth in U.S. Pat. Nos. 4,078,891; 3,044,276; 3,490,436; 3,733,060; 5,030,253; 3,576,593; 4,268,285; and 4,601,886.

A stand-alone purification system utilizing ultra-violet light and filtering is described in U.S. Pat. No. 3,744,216.

A complicated system for dispersing solid pellets and then ventilating them with an air stream is illustrated in U.S. Pat. No. 3,418,068.

The two devices known to applicants which are most related to their invention are described in U.S. Pat. Nos. 3,930,797 (Issued Jan. 6, 1976, to Albert E. Gertz) and 4,067,692 (Issued Jan. 10, 1978, to Richard W. Farris).

The first of these comprises a container disposed inside an air passageway with an openable door into which is put some kind of air treating substance. When the substance is exhausted, it is replaced by opening a small door accessible from outside the passageway. The chamber has a permanent set of pass-through apertures so that once inside the air passageway, whatever dispersant is within the container is dispersed uniformly until it is totally dissipated.

The second of these disclosures also pertains to a unit which is mounted to the wall of an air passageway. This unit provides for variable communication between a dispersant and an air passageway by means of rotating disks with apertures which move into varying degrees of misalignment or alignment, thereby regulating the amount of scent which reaches the air passageway.

None of these provide a relatively simple system, utilizing inexpensive modern electronic control technology, for exposing a dispersant to the air stream within an air passageway of an air conditioning or heating system in a controlled and programmable fashion.

SUMMARY OF THE INVENTION

The instant invention fulfills the above stated need by providing a microprocessor-controlled programmable system which drives a small axial-drive motor to insert a solid cylindrical dispersant through an opening in the wall of an air passageway for a period of time, and subsequently withdraw the dispersant back into a sealed chamber until the next time exposure time arrives.

It is an active system as opposed to a passive one, but it is also a very simple and basic active systems which combines all of the elements of versatility and control in other time-controlled systems with the simplicity of unit that is easily retro-fitted into the air conditioning or heating system of a building. It thus does not require the elaborate physical structure of a stand-alone unit.

BRIEF DESCRIPTION OF THE DRAWINGS

FIG. 1 is a partially diagrammatic illustration of the complete system;

FIG. 2 illustrates the dispersant insertion mechanism attached to the wall of an air passageway which is shown in phantom;

DETAILED DESCRIPTION OF THE PREFERRED EMBODIMENT

Figure 3:
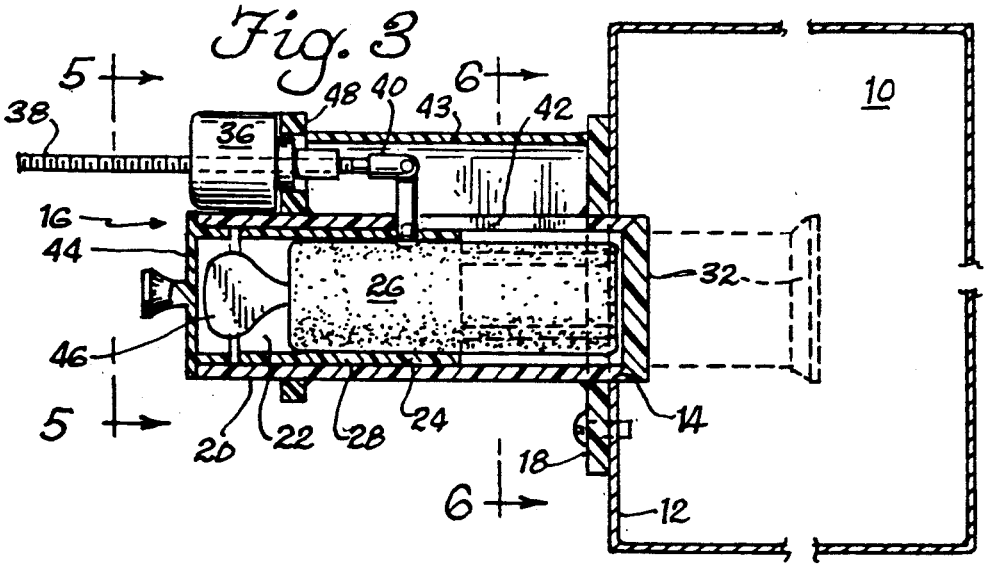
FIG. 3 is a vertical section taken longitudinally through the injector mechanism.

Turning to the mechanical aspects of the invention first, an air passageway is diagrammatically illustrated at 10 having a wall 12 in which an opening is cut at 14 to mount the dispersant carrier apparatus 16. As shown in FIG. 3, the apparatus has a forward mounting plate 18 which is screwed or otherwise attached to the wall 12, and mounts a housing 20 which is cylindrical and orthogonally extending relative to the wall 12. The housing defines a cylindrical internal chamber 22 which slidably seats the carrier 24 for the dispersant cartridge 26.

Figure 4:
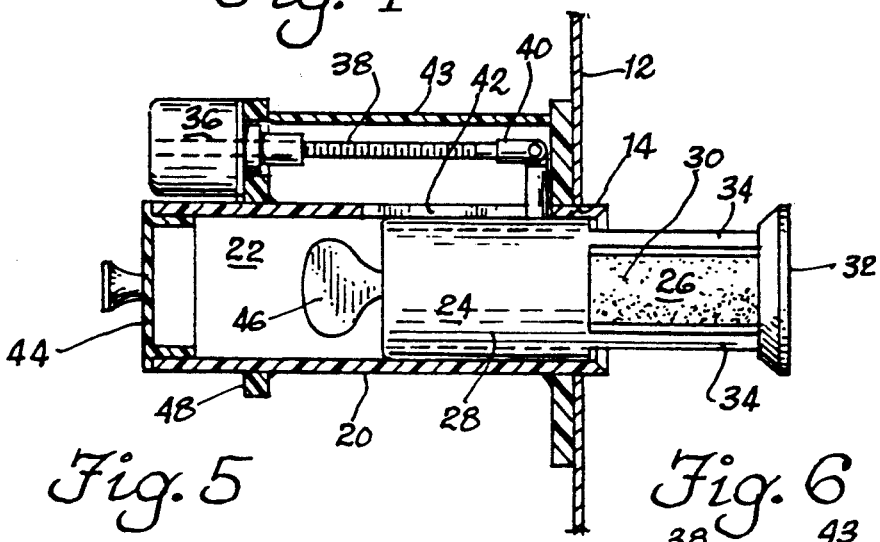
FIG. 4 is a view similar to FIG. 3 but with the dispersant pushed forward into its active mode.

The dispersant cartridge 26 has an enclosed rear end wall 28 which completely encloses the cartridge 26 with the forward end 30 of the carrier being almost completely open as illustrated in FIGS. 2 and 4, with an end cap 32 being supported only by four support ribs 34 which define a cage for the forward end of the dispersant cartridge.

FIGS. 3 and 4 show the two modes of operation of the carrier, the passive mode shown in FIG. 3, in which the end cap 32 of the carrier seals against the forward opening of the housing 20 to define a substantially sealed chamber to prevent evaporation of the dispersant, and an active mode shown in FIG. 4 in which the forward end of the dispersant is exposed to air in the passageway 10. There are two modes because it would waste dispersant to simply leave it in the air passageway when the air is not moving.

Mounted atop the housing 20 is a small axial-drive motor 36 with a shaft 38 which is threaded and directly extended by the internally threaded armature of the motor. As the motor operates to extend the shaft 38 either out or in, it is coupled to the carrier 24 with an elbow 40, there being a clearance slot 42 in the top of housing 20 to permit the elbow 40 to ride back and forth. A cover 43 seats over the shaft and elbow to protect them form dust and grime, and also to seal off the slot 42.

This can thus be seen that the motor 36 completely controls the extent to which the dispersant is exposed to the air and the ventilation passageway. The cartridge 26 is only partially exposed to the air in the passageway with the rear portion acting as a reservoir to wick out the saturating dispersant fluid to the forward portion of the dispersant cartridge to replace fluid as it is dissipated into the air. It is intended that the cartridge should last 30 to 45 days. After it is spent, the rear cover 44 is removed to remove the cartridge and replace it with a fresh one. For this purpose, the dispersant cartridge has a finger tab 46.

Figure 5:
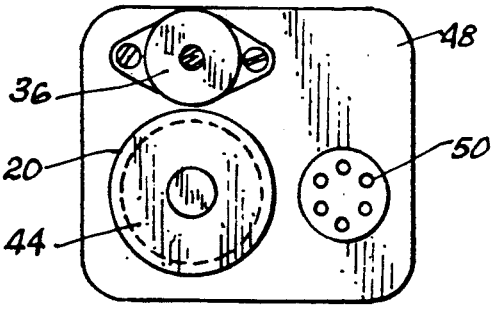
FIG. 5 is a section taken along the line 5—5 of FIG. 3.
Figure 6:
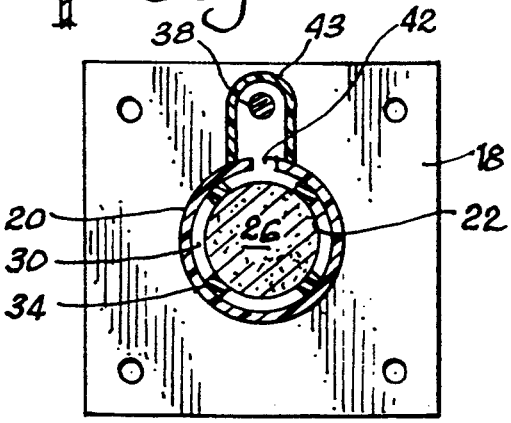
FIG. 6 is a section taken along the line 6—6 of FIG. 3.
Figure 7:
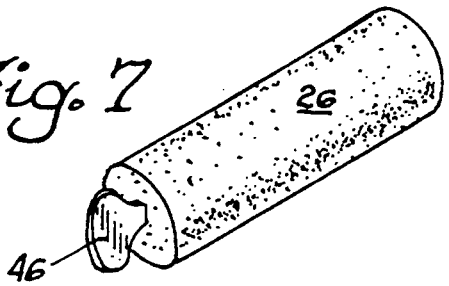
FIG. 7 is a perspective view of a dispersant cartridge.

A second plate 48 mounts the motor 36 to the housing 20 as best shown in FIG. 5. This plate also mounts a plug-in socket 50 which connects the motor to the combination driver and power supply indicated at 52. The driver comprises an AC switch controlled by a 5 Volt DC signal provided from the control unit 54, which in turn is powered from the power supply incorporated within the driver housing 52.

The control unit 54 is a programmable microprocessor-controlled system having a number of functions which will be summarized but not illustrated or described in detail inasmuch as these controllers are common and the one illustrated is not, by itself, inventive.

The controller is programmable to determine the times of day at which the carrier inserts the dispersant into the air passageway, and also the duration of such exposures. When it is time to insert the dispersant, the controller signals the power supply/driver 52, and the driver actuates both the motor 36 and a blower 56 which is part of the air conditioning or heating system. The blower 56 is powered directly from the driver 52, overriding its signals from its main heating or air conditioning system. The blower may be operated simultaneously with the insertion of the dispersant into the air passageway or may be separately controlled to stay on a few minutes or seconds after the dispersant is withdrawn to insure that all air having passed over the dispersant is actually delivered to the rooms of the building.

The controller 54 also has a manual override to permit the owner to turn the system off, or on continuously, irrespective of what its program dictates. The controller would ordinarily be mounted in a living room, such as would a thermostat, which is possible because it is a 5 Volt system. The power supply and driver 52, on the other hand, would not be accessible but would be down near the housing and carrier, adjacent to a cooling duct or other passageway.

The controller also has a battery backup to preserve the settings during a power failure, a battery test button, time set buttons, a reset button, and "low-medium-high" override in addition to the basic time of day and duration settings mentioned above.

The unit is thoroughly simple to install in any existing building having central heating or air conditioning. Because it is an active system rather than a passive one, it is very effective in extending the dispersant out well into the airstream to insure adequate dispersion. The solid, but saturated, dispersant cartridges that are used in preferred embodiment are easy to handle and relatively inexpensive, and yet each contain a large quantity of a powerful scenting liquid. Because it is retracted into its substantially sealed chamber in its passive mode, its lifetime is extended several times what it would be were it exposed continuously to the air and the adjacent air passageway.

The system is versatile, the programming is easy to understand, and the entire system adds a dimension of luxury to homes and commercial buildings which are constantly in need of new features to satisfy tenants and owners and to attract buyers.

It is hereby claimed:

1. For an air passageway having a wall with an opening therein, an apparatus for dispersing vapor into said passageway comprising:

(a) a dispersant;

(b) a movable carrier supporting said dispersant;

(c) a housing defining an internal chamber into which said dispersant can be withdrawn by said carrier in substantially sealed relation from said passageway; and, (d) means for selectively and automatically moving said carrier between an active mode in which dispersant is inserted at least partially into said passageway and a passive mode in which said dispersant is substantially withdrawn from said passageway into substantial non-communication therewith.

2. Structure according to claim 1 wherein said chamber is defined substantially externally of said passageway and said movable carrier slidably seats in said chamber in said passive mode, and slides substantially out of said chamber in said active mode to extend said dispersant into said passageway.

3. Structure according to claim 1 wherein said housing defines a closable entryway into said chamber on the side of said wall remote from said passageway to permit removal of said dispersant and the recharging of said chamber with fresh dispersant.

4. Structure according to claim 3 wherein said dispersant takes the form of a solid cylinder and said entryway is dimensioned to permit said solid cylinder to slide in and out of said chamber therethrough.

5. Structure according to claim 1 wherein said means for selectably and automatically moving said carrier comprises an electric motor of the axial shaft drive type.

6. Structure according to claim 5 and including an electronic and programmable control means for periodically actuating said drive means to move said carrier between said active and passive modes, sliding said dispersant into and out of said passageway.

7. Structure according to claim 1 wherein said chamber is substantially sealed except for an open end adjacent said passageway wall through which said carrier slides, and said carrier has an end cap which seats against said open end in said passive mode to substantially seal said dispersant within said chamber.

8. Structure according to claim 7 wherein said chamber comprises and elongated cylinder and said end cap is circular.

9. Structure according to claim 8 wherein dispersant comprises a substantially solid cylinder fitting substantially flushly within said elongated cylinder.

10. Structure according to claim 9 wherein said elongated cylinder has an end wall to enclose the end of said solid cylinder of dispersant which is remote from said passageway such that said end of said solid cylinder is never exposed to said passageway and acts as a reservoir to wick dispersant fluid to the other end of said cylinder of dispersant.

11. A method of dispersing volatile air freshener into a passageway of a heating or air conditioning system, said passageway having a wall with an opening therein, there being a substantially sealed chamber outside of said opening and said passageway, said method comprising the following steps:

(a) periodically during the day, inserting a mass of evaporable dispersant from said substantially sealed chamber through said opening into said air passageway; and, (b) after a period of time, removing said mass of dispersant out through said opening, from said passageway and inserting and substantially sealing said dispersant in said chamber as same is removed from said passageway.

* * * * *